United States Patent [19]

Mueller et al.

[11] 4,002,005

[45] Jan. 11, 1977

[54] PACKAGE OF NESTED CONTAINERS AND METHOD AND APPARATUS FOR PRODUCING SAME

[75] Inventors: Martin Mueller, Wonder Lake; David L. St. Clair, Wilmette, both of Ill.

[73] Assignee: Owens-Illinois, Inc., Ohio

[22] Filed: Feb. 6, 1975

[21] Appl. No.: 547,647

Related U.S. Application Data

[63] Continuation-in-part of Ser. No. 371,521, June 19, 1973, abandoned.

[52] U.S. Cl. ..... 53/26; 53/30 S; 53/143; 53/161; 53/184 S

[51] Int. Cl.[2] ..... B65B 35/58; B65B 35/44; B65B 53/02

[58] Field of Search ..... 53/26, 30 S, 33, 37, 53/159, 32, 161, 143, 144, 182, 184 S; 198/235, 236, 238, 266, 279, 281; 214/1 QA, 1 QD, 1 QF

[56] References Cited

UNITED STATES PATENTS

| | | | |
|---|---|---|---|
| 2,700,939 | 2/1955 | Liston | 53/122 |
| 2,867,537 | 1/1959 | Whitaker | 53/37 X |
| 2,932,929 | 4/1960 | Fahrenbach et al. | 53/196 X |
| 3,143,223 | 8/1964 | McIntyre et al. | 53/143 X |
| 3,253,694 | 5/1966 | Kinney | 198/235 |
| 3,504,476 | 4/1970 | Ehrenfried et al. | 53/30 S X |
| 3,660,961 | 5/1972 | Ganz | 53/26 |
| 3,750,876 | 8/1973 | Throberg | 53/30 S X |
| 3,788,463 | 1/1974 | Ruff | 53/30 S X |

*Primary Examiner*—Travis S. McGehee
*Assistant Examiner*—Horace M. Culver

[57] ABSTRACT

Multiple rows of nestable containers are continuously filled with product and sealed with a cover structure. Each other container in each row is inverted and the container inversion is alternated between rows to produce alternate rows of alternately inverted containers which are accumulated into nested groups. Cardboard support blanks are fed beneath the container groups in timed relationship with their accumulation into groups. Each group and cardboard support are simultaneously conveyed from the accumulation area to position the group on the cardboard support and form an assembly. The assembly is enveloped in a sheet of heat shrinkable film which is shrunken about the assembly to complete the package.

15 Claims, 17 Drawing Figures

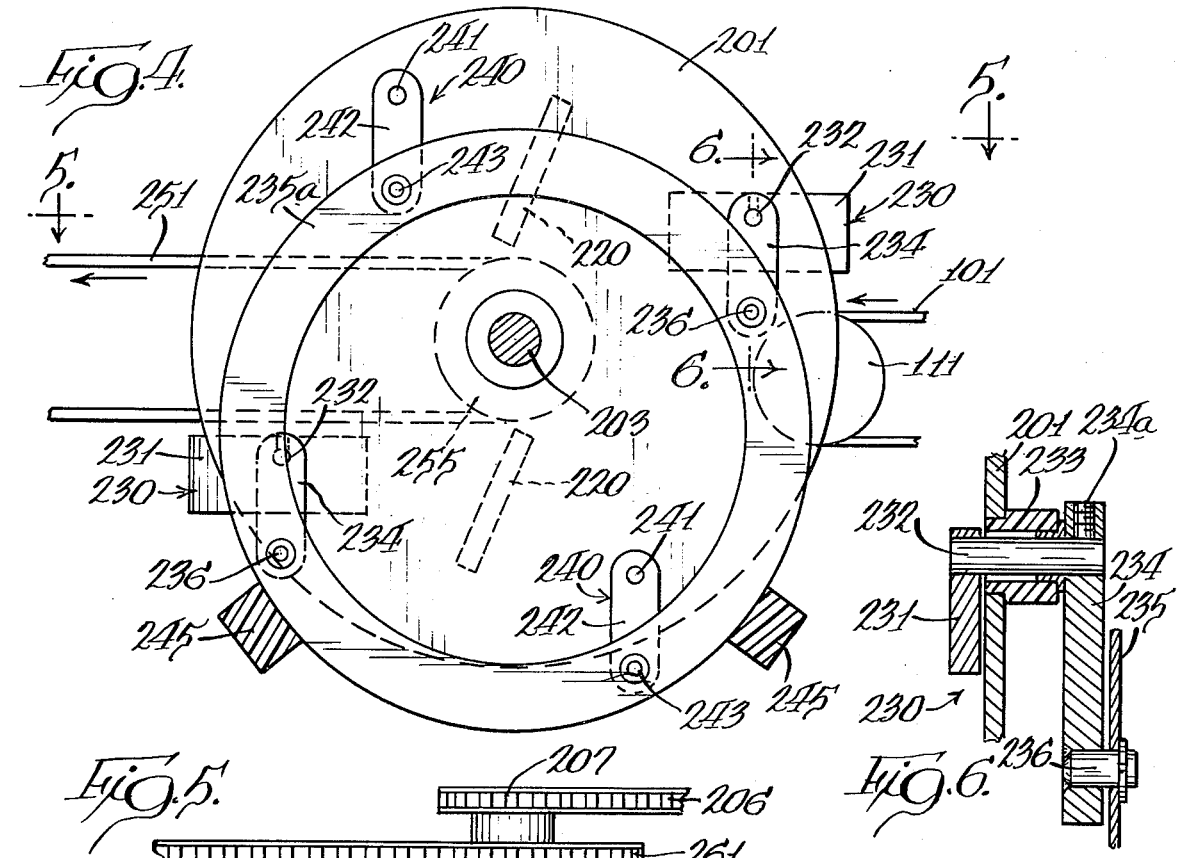
Fig. 4.
5.
6.
241
240
242
243
201
232
231
230
234
251
235a
220
101
236
111
203
255
245
Fig. 6.
201
234a
233
232
234
235
231
230
236
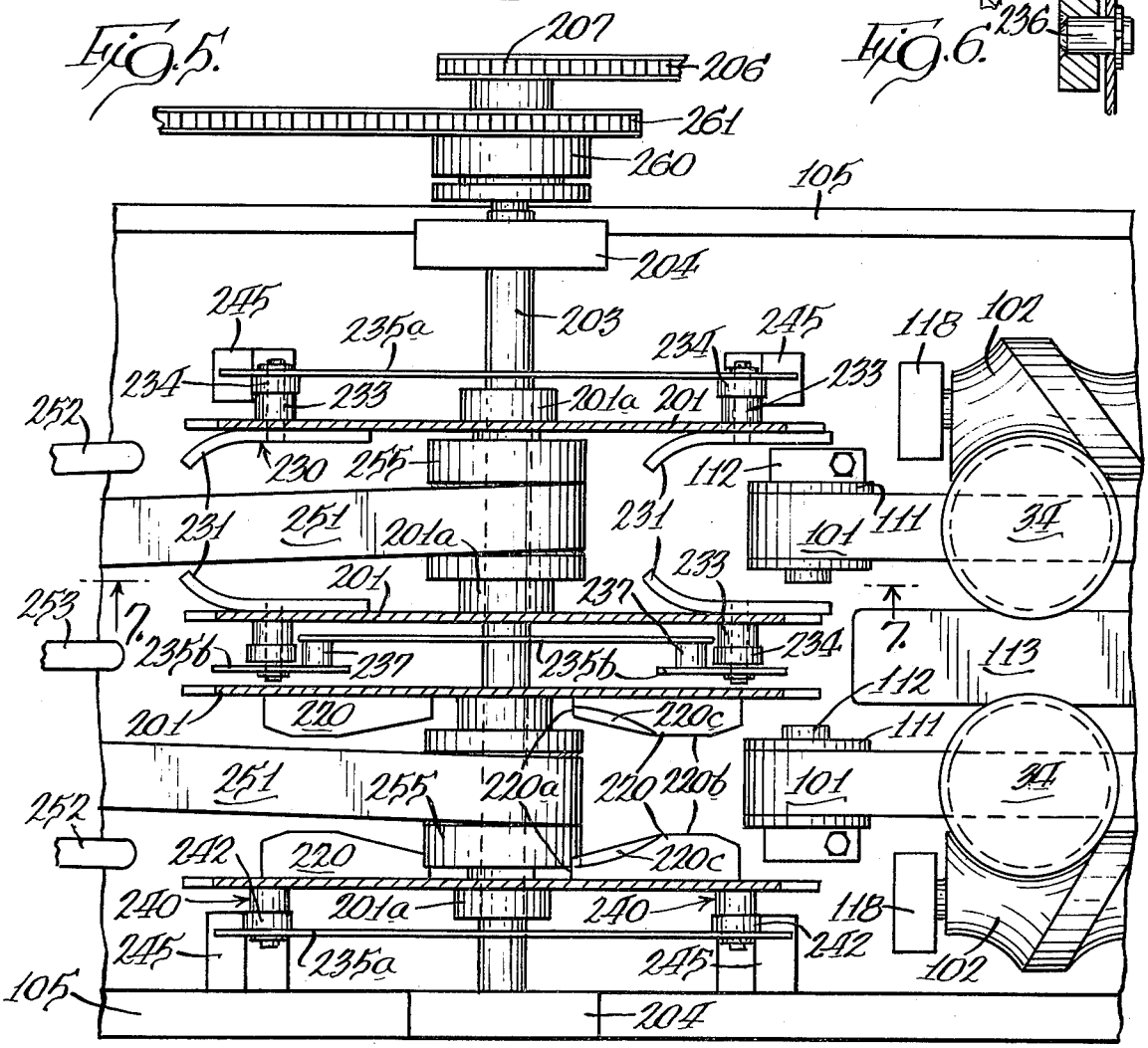
Fig. 5.
207
206
261
260
105
204
203
245
235a
234
233
201a
201
118
102
252
230
255
112
231
251
101
111
34
253
7.
235b
237
113
220
220c
220a
220b
242
240

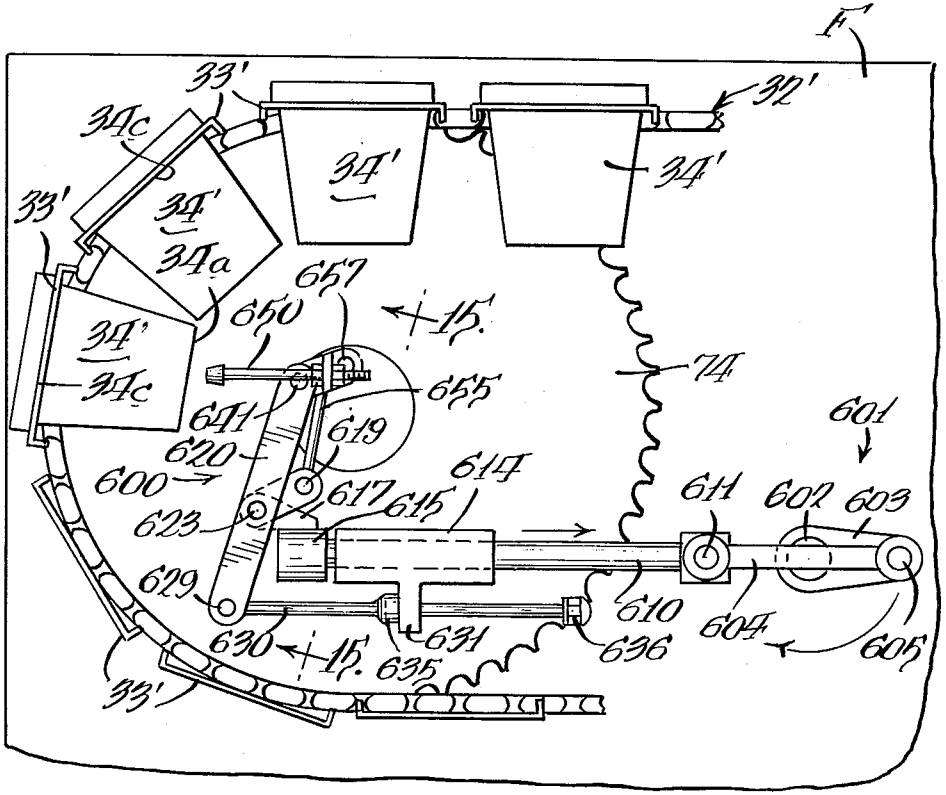
FIG. 14.
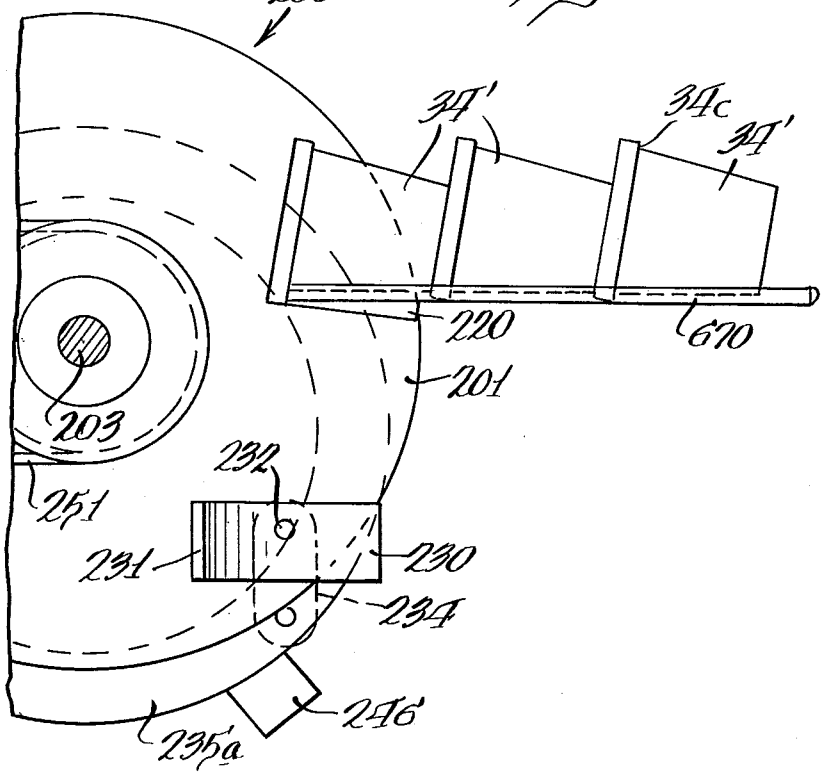

600
670
611
614
615
616
617
617a
617b
618
619
620
621
623
629
630
630a
631
635
636
638
639
640
641
644
650
653
655
656
657
658
659
33'
34'
34a
34c

PACKAGE OF NESTED CONTAINERS AND METHOD AND APPARATUS FOR PRODUCING SAME

This application is a continuation-in-part of application Ser. No. 371,521, filed June 19, 1973 and now abandoned.

BACKGROUND OF THE INVENTION

Individual sealed containers in various sizes, shapes and forms have become increasingly popular in packaging numerous comestible products, such as juices, milk, ice cream, yogurt, etc. Over the years it has become more and more prevalent to associate a plurality of such containers together for ease of handling during shipment and storage, and for ultimate sale as a unit.

Special types of packaging equipment have been developed that are capable of filling and sealing multiple rows of containers. For example, commonly assigned, copending Mueller U.S. patent application Ser. No. 282,758, filed Aug. 22, 1972, now U.S. Pat. No. 3,838,550 granted Nov. 1, 1974, discloses an apparatus for continuously filling multiple rows of containers, sealing the containers with a continuous film or foil, and severing the foil longitudinally and transversely between adjacent containers to produce multiple rows of filled and sealed containers.

With the ever increasing use of single portion product containers for institutional and other commercial uses, as well as for retail use, convenient packaging methods and packaging apparatus have become most important. With the advent of continuously operating filling machines, such as disclosed in the above-identified Mueller application, which are capable of producing large quantities of filled containers at high production speeds, new packaging apparatus and methods have become necessary to handle the output of such machines. Heretofore, containers have been packaged separately in groups by hand, or have been formed into interconnected upright groups associated together by carrier members, as disclosed, for example, in U.S. Pat. No. 3,539,071, or associated together by the container closure structure, as disclosed, for example, in the above-mentioned Mueller application. Hand packaging is obviously less efficient with respect to labor cost than a fully automated method. Interconnected upright group packages of containers result in considerable storage space and material cost increases. There has been a long felt need for a high speed collating and packaging technique which will economically produce a package consisting of a plurality of individual filled and sealed containers.

SUMMARY OF THE INVENTION

The present invention embodies a new concept for packaging nestable containers having different dimensions at opposite ends, e.g., frusto-conical shaped containers in closely nested groups of adjacently inverted containers which are enclosed in heat shrunken film to provide a convenient, highly compact package of multiple containers. More particularly, the method and apparatus of the invention are designed to maximize the output of packaged containers while reducing the overall size of the package.

The present invention involves a novel method and apparatus for inverting alternate containers, which are moved in rows through the apparatus and for the packaging thereof in groups. In addition to inverting alternate containers in each row, the inverting process is alternated between each row to permit nesting among adjacent containers and thus produce a group of alternately inverted containers. The term "alternately inverted containers" as used herein refers to container assemblies, either in a single row, multiple rows or other group in which adjacent containers are inverted.

The alternately inverted rows of containers are collated into nested groups of suitable size, such as a group of one dozen containers formed from two rows and six columns of containers and positioned on support members which are passed beneath the collated groups by transferring the groups colinearly and in timed relationship with the support member to form an assembly.

The assembly is enveloped in a sheet of heat-shrinkable thermoplastic film which is shrunken about the assembly to form the completed package.

The inverting apparatus consists of two rotatable pairs of coaxial spaced apart hubs which engage the containers therebetween by alternate sets of oppositely disposed inverting plates and transfer fingers.

In one embodiment of the invention, the transfer fingers receive alternate containers in an upright orientation and are provided with vertical counterweights whereby the fingers and containers are maintained in a horizontal, upright orientation while the hubs rotate to deposit the containers at the output of the inverting apparatus. The inverting plates receive and support alternate containers in a tipped position and as the inverting plates are rotated by the hubs, the containers are rotated and discharged in an inverted position.

In another embodiment of the present invention, the transfer fingers receive alternate containers in a horizontal orientation and rotate the containers into an upright orientation. Vertical counterweights ensure the fingers and containers are maintained in an upright orientation while the hubs rotate to deposit the containers at the output end of the inverting apparatus. Alternate horizontally oriented containers are fed onto inclined inverting plates, and as the inverting plates are rotated by the hubs, the containers are rotated and discharged in an inverted position.

DESCRIPTION OF THE DRAWINGS

FIG. 4 is an enlarged view of the inverting mechanism taken generally along line 4—4 of FIG. 3;

FIG. 5 is a sectional view of the inverting mechanism taken generally along line 5—5 of FIG. 4;

FIG. 6 is a sectional view of a transfer finger taken generally along line 6—6 of FIG. 4;

FIG. 14 is a side elevational view illustrating a transfer mechanism according to another embodiment of the present invention, with the transfer mechanism being shown in the fully retracted position;

DETAILED DESCRIPTION OF THE PREFERRED EMBODIMENT

Figure 1:
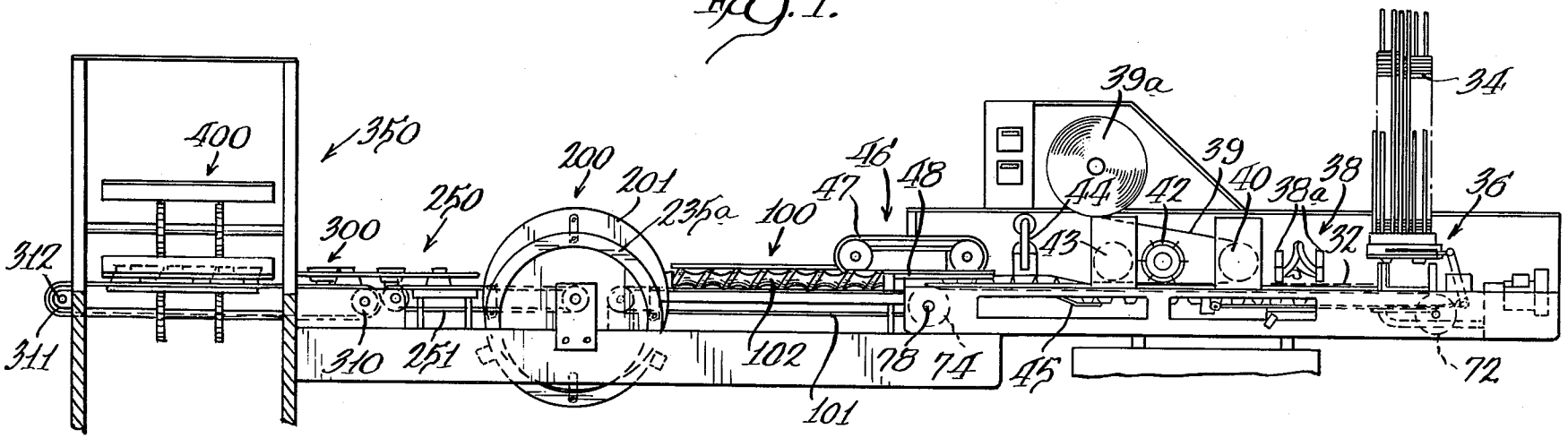
FIG. 1 is a fragmentary front elevation view of the packaging machine of the present invention.

While this invention is susceptible of embodiment in many different forms, there is shown in the drawings and will herein be described in detail, preferred embodiments of the invention with the understanding that the present disclosure is to be considered as an exemplification of the principles of the invention, and is not limited to limit the invention to the embodiments illustrated. The scope of the invention will be pointed out in the appended claims.

General Packaging System

Figures 3, 9:
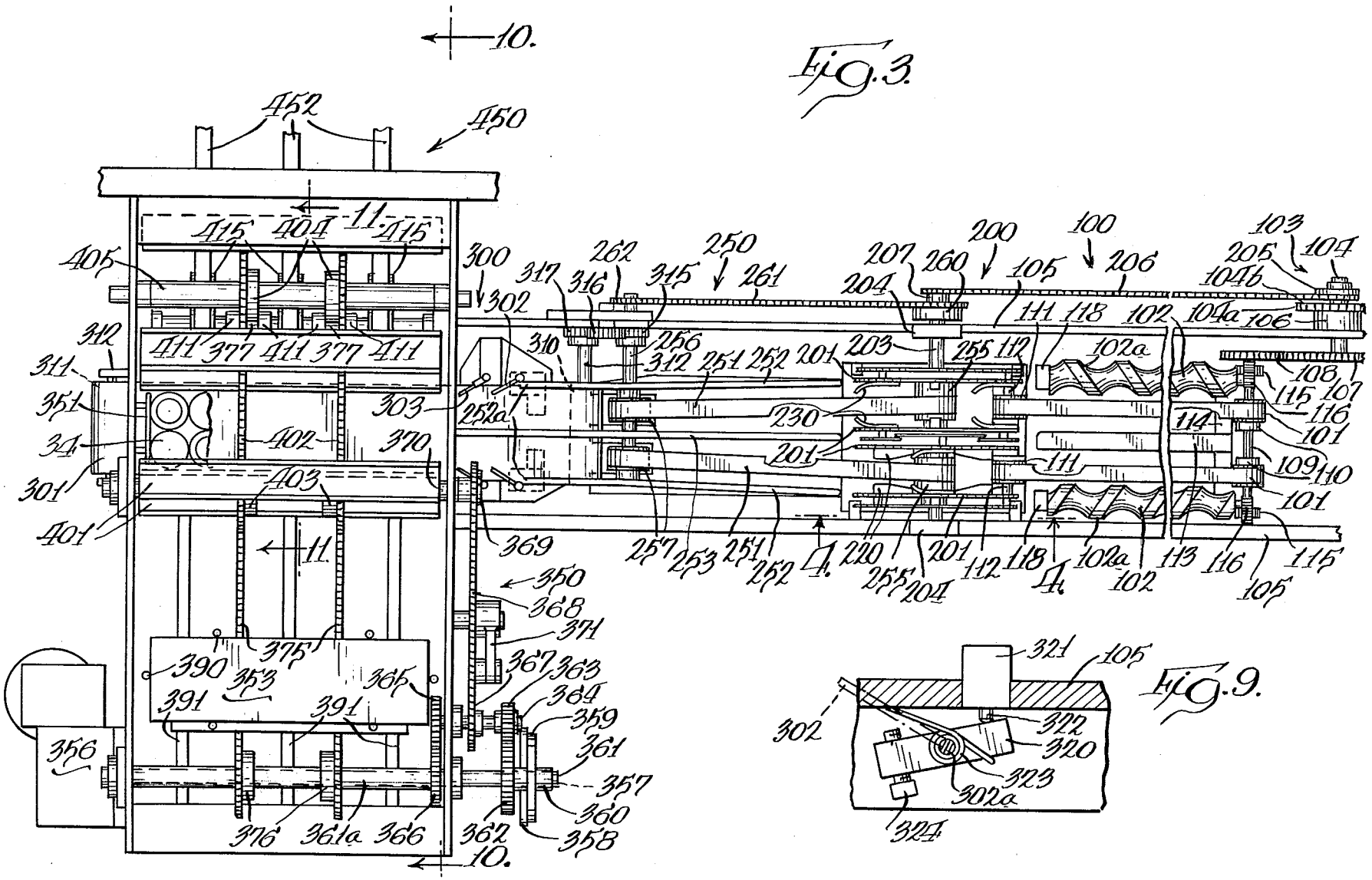
FIG. 3 is an enlarged plan view, with certain portions broken away, of the container inverting, collating and packaging portion of the apparatus shown in FIG. 1.
FIG. 9 is an enlarged sectional view of the collating stop mechanism.

The overall packaging apparatus of the present invention is illustrated in FIGS. 1 and 3. The apparatus is designed to work in cooperation with a continuous filling and sealing machine for nestable containers. One filling machine which is particularly adaptable for use with the packaging apparatus of this invention is disclosed in the above-mentioned Mueller application, the disclosure of which is hereby incorporated by reference.

Briefly, the Mueller filling machine, illustrated at the right-hand portion of FIG. 1, comprises an endless, continuously moving apertured conveyor means 32 that is capable of moving two or more rows of containers 34 along a horizontal path between sprockets 72 and 74. Containers are supplied to the conveyor means from nested stacks at a dispensing station 36. The conveyor means moves the containers to a filling station 38 where the containers are filled with flowable material from pairs of longitudinally spaced filling nozzles 38*a* positioned above each row of containers. Each nozzle dispenses a partial portion charge to each container as the containers are continuously moved along the path. After the containers have been filled, a continuous web 39 of film or foil that has heat-sealing characteristics is drawn from supply roll 39*a* and guided onto the containers by means of a rotating drum 40 which is provided with heater means to seal the web to the adjacent surface of the rims of the containers. The continuous web is then severed longitudinally and transversely by a cutter 42 to produce individual sealed containers. After the web has been severed, the containers pass beneath a second heat-sealing roller 43 spaced downstream from the cutter.

The individual containers are raised from the apertured conveyor means by support plate 45 located beneath the path of the containers. The raised containers pass beneath a first cover folding section 44 which consists of a reciprocating folding mechanism that causes the rectangular edges of the web beyond the container rims to be folded downwardly about the upper portion of the containers.

The raised containers move through a second cover folding station 46 consisting of a longitudinally disposed, moving belt 47 positioned between the rows of the containers, which rotates the containers about their center axis and transfers them longitudinally. As the containers are rotated and transferred, two longitudinal folding rails 48, disposed adjacent to each container row path at an elevation just below the container rims, fold the web into a final folded position about the container. The containers are then discharged from the filling machine to the packaging apparatus of the present invention, and in the illustrated embodiment, the containers are discharged two at a time, although it will be appreciated that more than two rows of containers may be provided.

As can be best seen in FIGS. 1 and 3, the container handling apparatus of the present invention includes an indexing conveyor means 100, a container inverting mechanism 200, transfer conveyor 250 and a collating apparatus 300. As will hereafter appear, these elements are all powered directly from the main filling machine in the illustrated embodiment.

The indexing conveyor means (hereinafter described in detail) comprises two parallel continuously moving belts 101 positioned in line with and adjacent the end of the main conveyor of the filling machine; and two longitudinal screw-type auger indexing members 102 parallel with and outwardly of belts 101, which receive the containers from the filling machine and which introduce them in timed-relationship to the inverting mechanism.

Briefly, the inverting mechanism consists of two pairs of spaced-apart, rotating plate-like hubs 201 positioned transversely to the path of the indexed container rows. Disposed from each pair of hubs 201 are alternative sets of opposing inverting plates 220 and horizontal transfer fingers 230. The transfer fingers receive indexed containers from belts 101 and transfer the containers in an upright orientation to the transfer conveyor 250. The inverting plates alternately receive containers from belts 101 in a tipped position so that the containers are supported on their sides by the inverting plates. As the inverting plates are rotated by the hubs, the containers are inverted and placed top down on transfer conveyor belts 251. The horizontal transfer fingers and inverting plates of each pair of hubs are staggered 90° between corresponding points on the hubs so that every other container in each row is inverted and the inversion process is alternated between rows.

Transfer conveyor 250, as will hereinafter appear, is comprised of two endless converging belts 251, which receive the alternately inverted containers from the converting mechanism and which carry the containers to the collating apparatus 300, where the container rows are positioned into nested groups due to the alternate inversion of adjacent containers.

As is hereafter described in detail, the collating mechanism 300 includes a continuously moving belt 301 (FIG. 3) which carries the rows of alternately inverted containers past stop fingers 302 and counters 303 to a fixed stop 351 in an accumulation area where the containers are grouped after a preset number of containers in each row, e.g. six, have passed counters 303. Stop fingers 302 are introduced into the container paths to prevent introduction of more containers when the preset number of containers are accumulated, and thereafter these containers are transferred as a group in timed-relationship with support members or trays through a film-duping and heat-shrinking operations.

A blank of support material 51, such as cardboard, on which the containers will be supported in the final package is fed from a supply stack 353 beneath the collating belt 301 in response to the counter signal. As the support member is moved beneath the transfer belt by an intermittent drive, the container group is transferred laterally by an overhead container transfer conveyor 400 (FIG. 1) to the collating conveyor, so that containers are positioned on the support member to form an assembly 425, FIG. 10. The assembly is then carried by a film wrap conveyor system 450, disposed laterally to the collating conveyor, to a continuous vertically-disposed film 451 of thermoplastic heat-shrinkable material at the end of the film wrap conveyor system.

Film 451 is provided from two source rolls 453 (FIG. 10) positioned above and below the film packaging conveyor. The thermoplastic film from each supply is joined to provide a continuous web fed from sources at either end thereof. When the container assembly reaches the end of the film wrap conveyor, it is in abutting relationship to the vertically-disposed film. A transfer mechanism 460 then pushes the container assembly into the film laterally to cause the film to partially envelop the assembly and transfers the container assembly across a gap onto a shrink tunnel conveyor 500. Two opposing vertically-disposed sealing and cutter dies 495 are positioned within the gap above and below the path of the container assembly, and are moved toward one another to wrap the thermoplastic film around the container assembly, seal the film thereabout, cut the film and seal the remaining film to provide a continuous web for further wrapping. The wrapped assembly then passes through a shrink tunnel which causes the thermoplastic material to shrink to the outer contour of the assembly and thus form the completed package.

The Package

Figure 2:
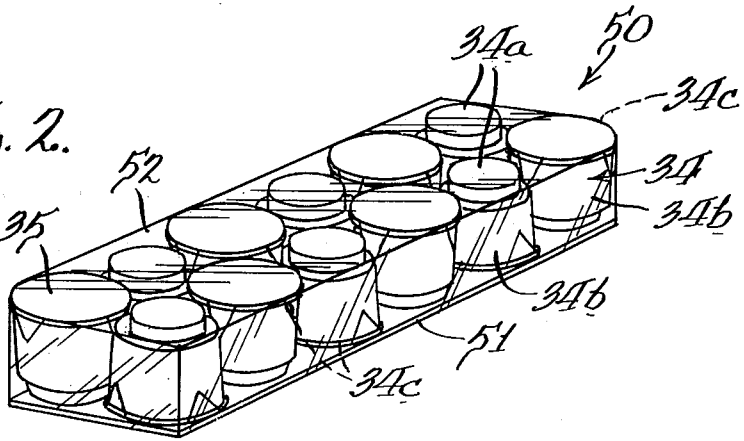
FIG. 2 is a perspective view of a package produced by the apparatus of FIG. 1.

A completed package 50 as produced by the method and apparatus of the present invention, is shown in FIG. 2 and consists of a nested group of frusto-conical shaped containers 34 that have a circular bottom 34*a*, and an outwardly flowing sidewall 34*b* extending upwardly therefrom, with a circular rim 34*c* extending outwardly from the upper end of the sidewall. Containers 34 may be formed of any suitable material, well understood to those skilled in the art, and the sidewall may be ribbed, smooth, plain or decorated.

The containers 34 are sealed at their rims by suitable means 35, such as by the use of foil or film, as described in the above-mentioned Mueller application. However, the method and apparatus of the present invention have equal applicability to containers that are sealed with different types of closures, as will readily occur to those skilled in the art. It should also be noted that the present invention is not limited to any specific container shape, so long as the containers are susceptible of adjacent nesting.

As illustrated in FIG. 2, package 50 consists of one dozen containers lying in two rows of six containers each. Alternate containers in each row are inverted so that adjacent containers in each row nest top to bottom with adjacent containers in the row. Moreover, the container inversion of each row is alternated so that the containers in one row nest, top to bottom, with adjacent containers in the other row. It will be appreciated, of course, that other container configurations having greater numbers of rows and/or different numbers of containers in each row may also be formed with the method and apparatus of this invention.

The containers 34 are supported on a thin, flat generally rectangularly shaped support member 51 formed from a suitable material, such as cardboard, polystyrene, or the like. The entire assembly of containers and support member is enveloped in a sheet 52 of shrunken thermoplastic material which maintains the cups in their nested position upon support member 51. The sheet 52 may be clear, as illustrated, or may be colored, transparent, opaque, or printed with indicia and other decorative markings.

Indexing Conveyor

With reference to FIG. 3, longitudinally disposed transfer conveyor belts 101 and indexing augers 102 are continuously driven by container handling drive 103 which is powered from the main filling machine. To this end, the transversely extending driven conveyor shaft 78 (FIG. 1) is connected to a parallel transversely extending shaft 104 downstream thereof, by means of a chain 104*a* and sprocket 104*b*, which is keyed to shaft 104, thereby to provide timed drive between the filling machine and container handling apparatus. Shaft 104 is rotatably mounted upon a longitudinally extending side frame member 105 by bearing 106, and a drive gear 107 is mounted upon the inner end of shaft 104. Gear 107 meshes with a gear 108 carried by a transversely disposed shaft 109 at the input end of the indexing conveyor, and belts 101 are trained over pulleys 110 keyed on shaft 109 and over pulleys 111 mounted on idler shaft assemblies 112 at the other end of the indexing conveyor. The upper reach of belts 101 are disposed in a common plane, or slightly beneath the plane of the lower surface of the containers emerging from the filling machine so that the containers are smoothly transferred to the indexing conveyor.

A guide bar 113 is positioned centrally of belts 101 and cooperates therewith and with augers to define parallel process paths. The augers and guide bar are positioned at the elevation of the container sidewalls and the transverse distance between the edge of the bar and the minimum diameter of the auger correspond to the approximate diameter of containers 34 so that containers will be indexed and spaced equally from one another by the auger flights 102*a*. Guide member 113 is suitably mounted on the machine frame, as by support member 114, and extends from the output of the filling machine to the inverting mechanism 200.

Indexing augers 102 are also driven from drive shaft 109 through a right angle drive gear 115 on shaft 109 and gears 116 mounted on the ends of the augers. The opposite ends of the augers 102 are mounted in journals 118 adjacent the inverting mechanism.

As containers are fed from the filling machine, they are carried on belts 101 and indexed and spaced by augers 102 to be introduced two at a time, one from each row, into the inverting mechanism in timed sequence with the rotation of hubs 201. To this end, belts 101 extend partially into the inverting mechanism between the pairs of hubs 201 to present the containers in proper orientation to the inverting mechanism, as will be discussed in greater detail below.

Inverting Mechanism

As containers are introduced into the inverting mechanism by belts 101 and augers 102, inverting mechanism 200 inverts every other container in each row, and the inversion process is alternated between rows. The inverting mechanism receives power from the aforementioned drive shaft 104, and to this end, the inverting mechanism is carried by a shaft 203 that is parallel with shaft 104, and which is rotatably mounted in side frame members 105 by bearings 204. Shaft 203 is driven by a chain drive from shaft 104 which includes sprocket 205 on shaft 104, chain 206 and driven sprocket 207 on shaft 203.

Referring to FIG. 5, the two pairs of parallel spaced hubs 201 of the inverting mechanism 200 are mounted axially is spaced relationship on shaft 203 by collars 201a associated with each hub. As is evident from FIGS. 4, 7 and 8, shaft 203 is positioned above the elevation of shaft 112 to facilitate the inverting process as discussed below. The inverting plates 220 of each pair of hubs 201 are diametrically opposed and located in facing relationship as can be appreciated by comparing FIGS. 4, 7 and 8 to FIG. 5. The inverting plates of each pair are parallel to the inverting plates of the other pair on each hub and are skewed radially from the center of the hub.

Figure 8:
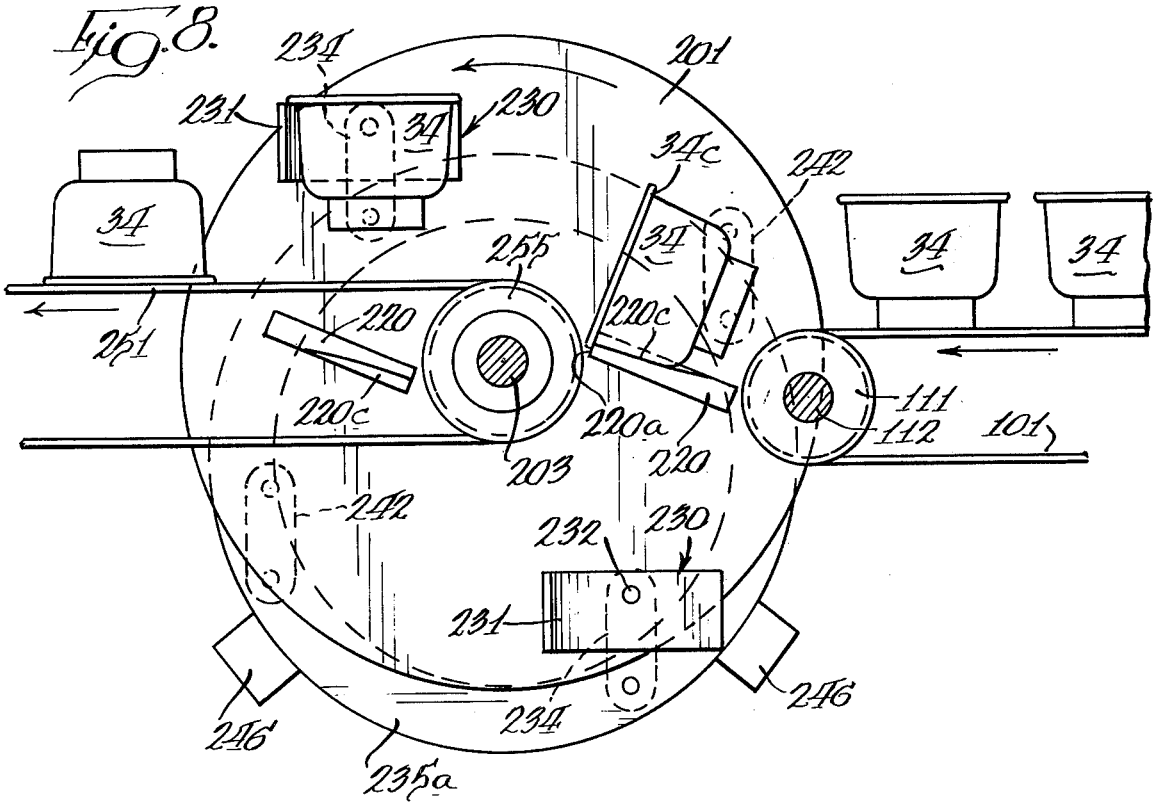
FIG. 8 is a sectional view similar to FIG. 7 illustrating a container being carried through the inverting mechanism in upright alignment.

Referring to FIG. 8, as alternate containers 34 from each row are fed to the inverting mechanism by belts 101, which extend between the pairs of hubs, the containers to be inverted are fed off the end of the belts so that the containers will be tipped as they pass over the arcuate turn of pulley 111. As the containers are being tipped, the inverting plates are positioned at an upwardly inclined angle and support the sidewall of the containers, with the container rim **34*c* engaging the interior edge 220*a* of the inverting plate to hold the container thereon. It will be appreciated that the skewed orientation of plates 220 function to present the plates in proper orientation with a tipped container, as shown in FIG. 8**.

Each plate 220 has opposing contoured edges **220*b*, FIG. 5, to define a shaped bearing edge which supports the container sidewalls. Edges 220*b* converge toward one another from the inner end of the plates to provide a gap, generally corresponding to, but slightly smaller than the container sidewalls, wherein the containers are carried. The top edges of the converging portions of plates 220 provide an angled surface 220*c* which define a container engaging surface generally corresponding to the curved sidewall 34*b*** of the containers.

Figure 7:
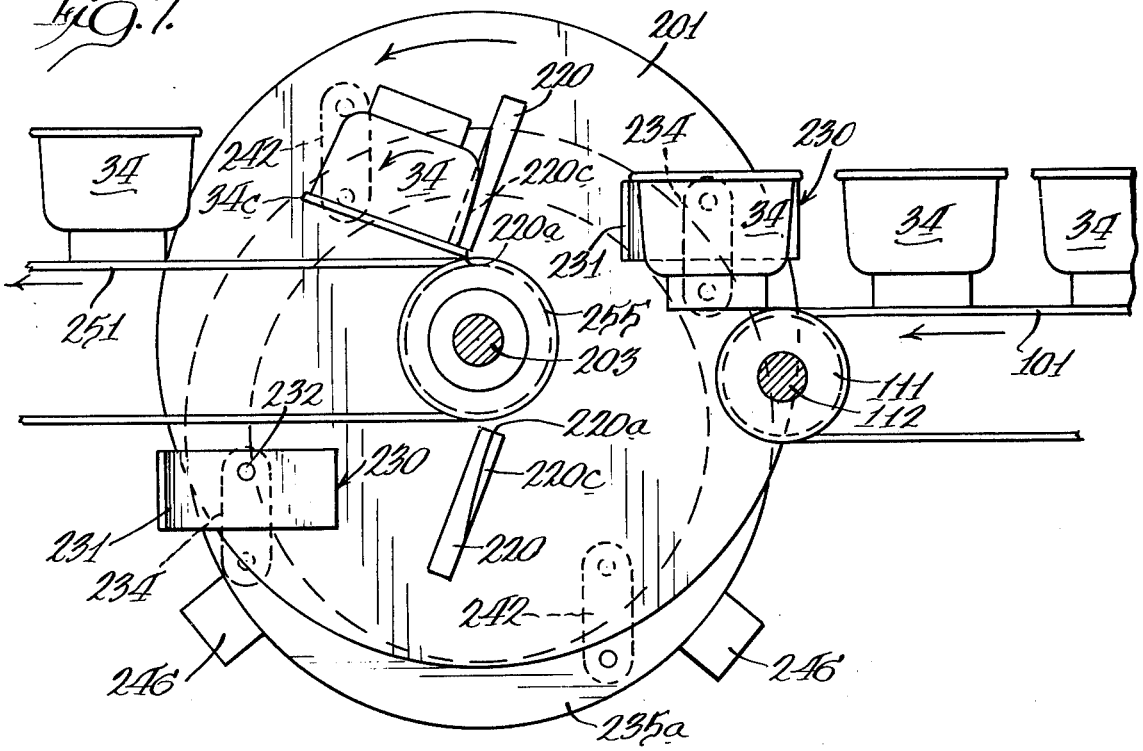
FIG. 7 is a sectional view taken generally along line 7—7 of FIG. 5 and showing a container being inverted.

The hubs are rotated through an angle of about 90°, FIG. 7, causing the inverting plates to deposit the container positioned thereon with the top thereof adjacent to the surface of a corresponding transfer belt 251 which is mounted at one end on shaft 203 by pulley 255. Thus, alternate containers in each row are presented top down on belts 251. As best illustrated in FIG. 5, belts 251 are smaller in width than the gap between the inverting plates so that, as the belts receive the containers from the hubs, the plates may continue to rotate.

Two pairs of pivotal transfer finger assemblies 230 are disposed at locations spaced 180° around each set of hubs. Transfer finger assemblies 230, FIGS. 5 and 6, comprise a curved finger 231, the pairs of fingers defining a container gap to receive containers from belts 101. Fingers 231 converge at their downstream end to engage the containers therebetween. Each finger 231, FIG. 6, is pivotally mounted to its respective hub 201 by means of horizontal shafts 232, which pass through bearing mounts 233 in the hub. Shaft 232 is counterbalanced by a vertically disposed arm 234 fixedly attached to the end of shaft 232, as by set screw **234*a* and an annular counterweight 235 pivotally connected to the free end of arm 234 by pin 236**. The counterbalance mechanism is designed to maintain the transfer fingers in a horizontal orientation as they are rotated.

With particular reference to FIGS. 4 and 5, each outermost counterweight is provided by an annular ring **235*a* which is pivotally attached to its respective hub by the counterbalance arms and pins, and a pair of support assemblies 240 which are spaced 90° from each of the transfer fingers 231. Support assemblies 240 are similar to the counterbalance mechanism for the transfer fingers and include a pin 241 secured to the hub, a vertically disposed arm or link 242, pivotally attached at one end to pin 241 and to ring 235*a* at the other end by pin 243. Rings 235*a* rotate in an eccentric manner with respect to hubs 201 due to arms 234 and 242 to maintain fingers 231 in a horizontal orientation. To prevent lateral movement of the rings during rotation, the rings are supported by their periphery by two spaced apart frame mounted frictionless slide blocks 245**.

Referring to FIG. 5, the two interior hubs 201 are provided with a single counterweight **235*b* comprised of four 90° segments which are interconnected at their end portions by blocks 237 to provide a continuous 360° counterweight. The use of four 90° segments provides a single continuous annular counterweight and provides proper spacing for bearing mounts 233. The transfer fingers on the two inner hubs are mounted to the ring 235*b* in the same manner as the outer hub transfer fingers, and since there are four contact points with ring 235*b*, there is no need for support assemblies 240 on the inner ring. The inner ring is also supported by two slide blocks (not shown) similar to block 245** at spaced locations at its periphery.

The pairs of transfer fingers and inverting plates in one pair of hubs is staggered 90° from the corresponding pairs of inverting plates and transfer fingers in the other pair of hubs so that the inversion of containers is alternated between rows, as well as in each row.

As the containers, which are to be maintained in their upright position, are fed to the inverting mechanism from belts 101, the transfer fingers are rotated into position beneath the lower edges of the container rims **34*c* as the containers are fed from the belts so that the containers move between the fingers and are engaged with their rims 34*c* resting upon the upper surfaces of finger 231. As the hubs continue to rotate, the transfer fingers are maintained in a horizontal position due to the counterbalance weights 235*a* and 235*b* so that, as the containers are transferred to the belts 251**, they are positioned thereon with the bottom of the container adjacent the belt.

The spacing between the pairs of transfer fingers 231 is greater than the width of belts 251 to allow the fingers to deposit the containers and continue rotating. As the containers are placed on the belts, they are guided therealong by means of longitudinally extending guide tracks 252 and 253 parallel with belts 251, which assure positioning of the containers on the belts.

Collating Mechanism

Referring to FIG. 3, the alternately inverted rows of containers are fed longitudinally by transfer belts 251 to collating belt 301 where the containers are grouped for packaging. The transfer conveyor means 250 comprises two driven belts 251 which are mounted at the upstream end on hub shaft 203 by pulleys 255 and at the downstream end on conveyor drive shaft 256 by pulleys 257. Drive shaft 256 is driven from shaft 203 by a chain drive to provide for timed-drive between the inverting mechanism, transfer belts and the collating mechanism. The chain drive includes sprocket 260 mounted on hub shaft 203, endless chain 261, and driven sprocket 262 on shaft 256. Pulleys 257 on shaft 256 are spaced closer to one another than pulleys 255 on shaft 203, so that the belts 251 converge at the output thereof to bring the container rows together into close adjacency with one another for transfer onto the collating belt. As the containers are carried on belts 251, they are guided by the above mentioned longitudinally extending guide members 252, which are spaced on the outside of the belts and which converge toward one another and toward a centrally disposed guide track 253.

The collating belt 301 is continuously driven and comprises an endless belt member which is positioned adjacent output end of belts 251. The end portions 252*a* of guide members 252 are parallel with one another and extend over the collating belt to define straight guide portions which direct the containers into the collating belt 301 in parallel rows.

Collating belt 301 extends through the final packaging apparatus 350 in line with the output of the main filling machine, and is mounted on two spaced apart rollers 310 and 311 (FIG. 1). Roller 310 is positioned on drive shaft 312 at the output of the belts 251 and roller 311 is mounted on a frame mounted idler shaft assembly 313 at the left end of the machine. Drive shaft 312 receives power input from shaft 256 through a gear train system to provide timed drive therebetween and the gear train system comprises gear 315 mounted on shaft 256, gear 317 mounted on drive shaft 312, and frame mounted transfer gear 316 which meshes with gears 315 and 317.

Spaced downstream from the input end of collating belt 301 adjacent the container row paths at the end of guide members 252 is a set of oppositely disposed air cylinder operated stop fingers 302 which are adapted to intercept and hold the oncoming rows of containers after a preset number of containers have been accumulated downstream of fingers 302. Central guide 253 extends beyond the location of the stop fingers and cooperates therewith to hold the containers in place on the collating belt when the stops are introduced into the container paths. Counter fingers 303 are disposed adjacent to stop finger 302 and count the containers in each row as they are conveyed by belt 301 toward a transversely disposed stop member 351 near the end of the belt. The counter fingers 303 supply input to a commercially available control system (not shown) which operates stop fingers 302 and control the drive to the packaging apparatus described below.

With reference to FIG. 9, the stop fingers are provided with a vertical stub 302*a*, and lower end of which is fixedly positioned in the center of a horizontal pivot link 320 which is pivotally mounted (not shown) to frame member 321*a*. An air cylinder 321 is mounted transversely to one end of the link in frame member 312*a* and rod 322 extending therefrom bears against link 320 to cause the fingers 302 to pivot into the container path when air is supplied to the cylinder. Spring means 323 is provided to pivot the fingers out the container path when air is not supplied to cylinder 321. An adjustment stud 324 is threaded through the other end of pivot lever 320 to control the penetration of the stop fingers into the container paths when they are pivoted. The counter fingers 302 and control system actuated thereby function to permit a pre-selected number of containers, e.g. six containers in a row, to pass into the packaging apparatus and then actuate the air cylinders to stop the flow of containers in that row.

Container Packaging Transfer System

Figure 10:
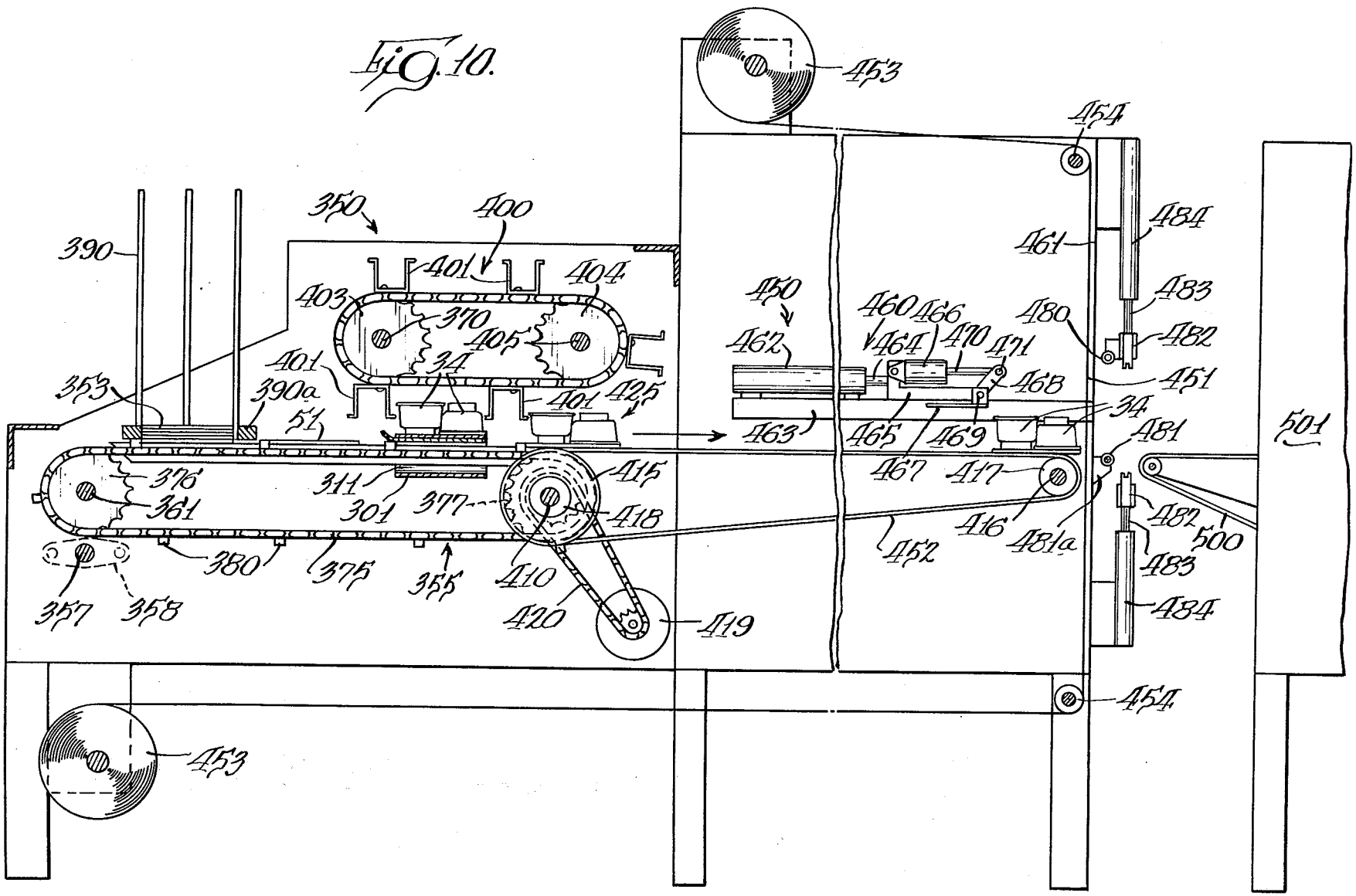
FIG. 10 is a sectional view taken generally along line 10—10 of FIG. 3.
Figure 11:
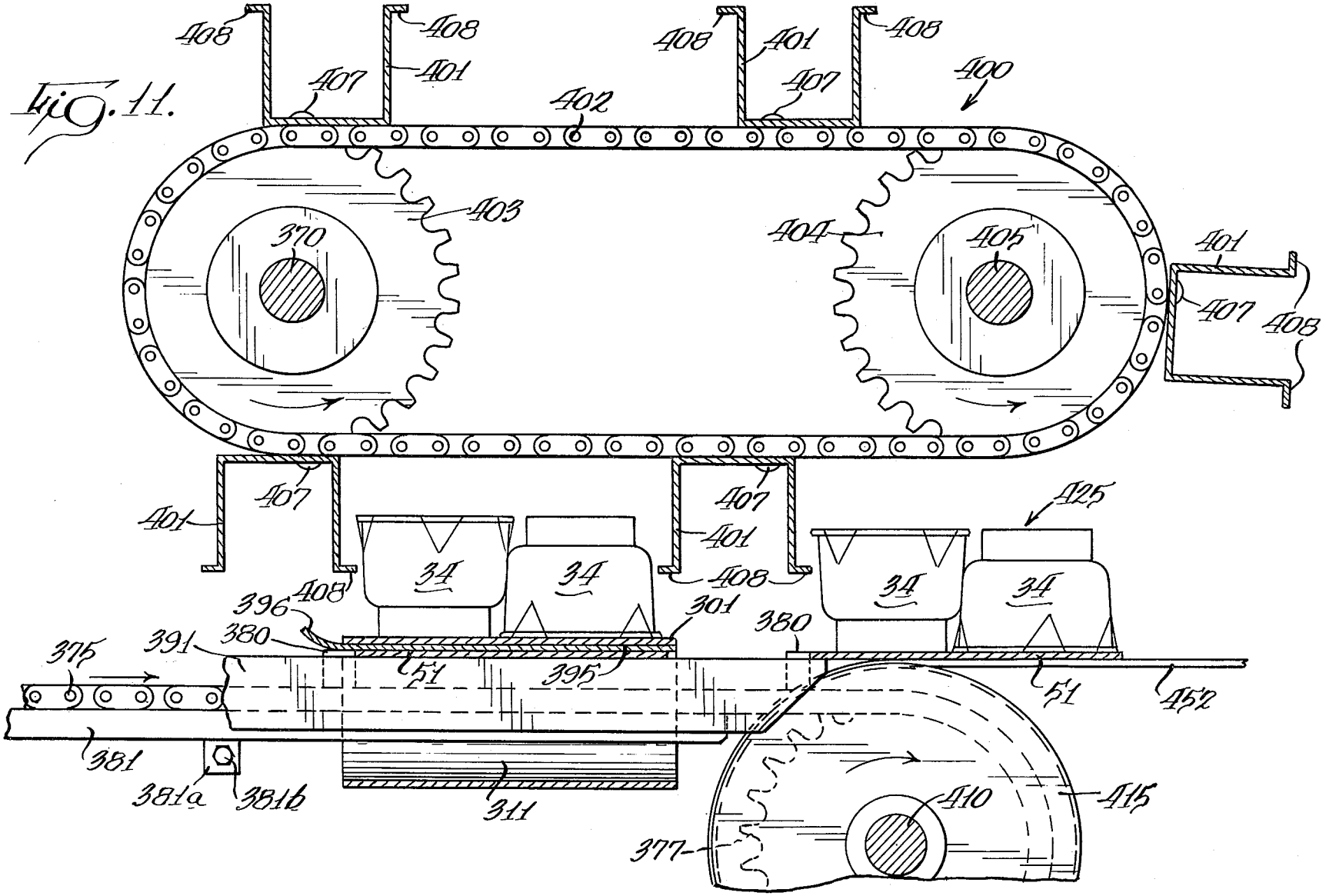
FIG. 11 is an enlarged sectional view taken generally along line 11—11 of FIG. 3 and illustrating the container group transfer apparatus.

As the alternately inverted containers are fed longitudinally by collating belt 301 to stop 351, they pass between opposing lateral transfer members 401, FIGS. 10 and 11, which are carried by a conveyor system 400. After a pre-selected number of containers have passed between the transfer members, the counter control system stops the flow of containers toward stop 351 and provides a timing signal to the drive for the final packaging apparatus 350.

A cardboard support member 51 is fed intermittently from a stack supply 353 under the collating belt 351, and the nested container group and the group is transferred laterally by transfer elements 401 and onto the cardboard support as it emerges on the opposite side of belt 301. The cardboard support 51 is transferred by conveyor means 355 which is intermittently driven in timed relationship with the transfer element conveyor 400, so that the container groups and cardboard support therefore are sequentially fed laterally to the main process path and transferred to a film-wrap conveyor 452, disposed transversely to collating belt 301 and in line with the cardboard support conveyor 355.

Drive is supplied to the transfer conveyor 400 and the cardboard support conveyor 355 from a main drive assembly 356, FIG. 3, that is controlled by a signal from the counter fingers' control system to provide timed drive with the collating operation. Assembly 356 drives frame mounted shaft 357 (FIG. 10) through a control clutch to provide power to a driver 358 of a geneva mechanism which intermittently rotates geneva follower 359. Geneva follower 359 is mounted on a collar 360 for free rotation on shaft 361 disposed above and parallel with drive shaft 357, FIGS. 3 and 10. Drive is supplied to cardboard support conveyor 355 and to transfer conveyor 400 by a gear 362, which is also fixedly attached to collar 360, and which meshes with a smaller gear 363 on frame mounted stub shaft 364. Gear 363 drives a reversing gear 365 on stub shaft 364, which meshes with gear 366 on tube shaft 361*a* that is mounted concentrically with shaft 361 and is freely rotatable thereon.

Container transfer conveyor 400 is driven by a sprocket 367 (FIG. 3) on stub shaft 364, and a chain 368, which drives a sprocket 369 at the end of frame mounted drive shaft 370 to drive the container transfer conveyor, The drive chain is adjustable by means of a frame mounted idler assembly 371.

As the containers are fed by collating belt 301 to stop 351, the transfer elements on conveyor 400 are positioned to allow the container groups to pass therebetween as shown in FIGS. 10 and 11. The transfer conveyor comprises two spaced endless chains 402 positioned transversely to the collating belt above the level of the containers by sprockets 403 and 404. Sprockets 403 are mounted on shaft 370 above one side of belt 301 and are driven, as described above, by the geneva drive mechanism to provide intermittent operation thereof. Sprockets 404 are mounted on frame mounted idler shaft 405 above the other side of belt 301.

Transfer elements 401 are attached at spaced locations along the chains by pins 407 and comprise elongated generally U-shaped members which are provided with outwardly facing flanges 408 at the free ends of each leg. Opposing flanges 408 of adjacent transfer elements form a guide for collating the containers in nested groups and for engaging the tapered sidewalls of the individual containers of the container groups to transfer them from the collating belt to the film wrap conveyor in timed relationship with the movement of the cardboard support, as shown in FIG. 11.

Support member conveyor 355, FIG. 3 and 10, consists of two endless chains 375 trained over sprockets 376 and 377 on spaced shafts 361 and 410, respectively. Sprockets 376 are keyed to tubular shaft 361*a* on shaft 361 to provide drive to the conveyor, and sprockets 377 are freely rotating on frame mounted shaft 410. Sprockets 377 are positioned on shaft 410 by spacers 411 located adjacent each side of the sprockets on shaft 410 to maintain the sprockets 377 in line with sprockets 376. Chains 375 each carry a plurality of transfer fingers 380 which extend upwardly from the chains, with the fingers on each belt 380 being aligned with one another.

The upper reach of each chain 375 is supported by elongated support rails 381, FIG. 11, attached to the frame at spaced intervals, as by bracket 381*a* and bolts 381*b*. Cardboard support members 51 are stripped one at a time from the bottom of a stack supply within a dispensing mechanism 390, the lower portion 390 of which retains the rest of the stack against movement during the stripping step. The upper surfaces of three spaced guide tracks 391, which extend from the supply mechanism beneath belt 301 to shaft 410, are disposed in a common plane below lower portion 390*a* by a distance slightly in excess of one support member thickness, and fingers 380 transfer the cardboard supports laterally beneath the collating belt 301 in timed relationship with the lateral movement of the container groups.

The upper reach portion of belt 301, FIG. 11 is supported on a plate 395 which maintains the belt at an elevation which permits the movement of conveyor 355 therebeneath. The left-hand edge 396 of plate 395 is flared upward to provide a camming surface and guide for the leading edge of the support member being moved by transfer fingers 380 to thereby insure that the support members will pass beneath belt 301 without jammming.

Although the drive to conveyors 355 and 400 is intermittent, it will be appreciated that the operations are performed continually in response to the continuous flow of containers. In the event that the containers are not to be wrapped automatically, stop 351 may be removed and the alternately inverted containers may be fed out the end of the machine for other processing.

As an alternate to lateral displacement of the container groups and support members, straight through operation of apparatus is possible by modifying the support member conveyor 355 so as to introduce support members at the output of belt 301 beneath the groups as they are moved thereabove after collating.

Film Wrap Mechanism

As the container groups and carboard supports are fed laterally from the container handling process path, as described above, they pass onto a continuously moving film wrap conveyor means 450, FIG. 10. Film wrap conveyor means consists of a plurality of continuously moving belts 452 disposed in line with the container transfer mechanism at the elevation of the upper portion of the collating belt. Belts 452 are trained over pulleys 415 on shaft 410 and over pulleys 417 on frame mounted idler shaft 416. Shaft 410 is driven by end mounted sprocket 418 from an independent power source 419 through chain 420. As the containers and cardboard supports are fed onto the film wrap conveyor, the containers are placed onto the cardboard, and the resulting assembly is carried laterally on the belts 452 beneath a pusher assembly 460 to the end of the conveyor where they are positioned in abutting relationship with a vertically disposed continuous sheet of film 451.

As indicated above, the container assembly is wrapped in the film by pushing the assembly into engagement with the vertical film to cause the film to drape around and partially envelope the containers. Film is supplied from two horizontally positioned supply rolls 453 which feed the film horizontally to two transverse rollers 454 disposed horizontally at spaced vertically aligned locations above and below the end of the film wrap conveyor. The film from each roll is joined by heat-sealing to provide a continuous film, as will hereafter appear.

When the container assembly has reached the end of the film wrap conveyor, an air-operated pusher assembly 460 positioned above the containers on the frame 461 is actuated, as by sensing means (not shown), to push the assembly into engagement with the film, across a gap to the shrink tunnel conveyor 500, and thus partially envelope the assembly with the film. The pusher assembly comprises a main air cylinder 462 positioned longitudinally above the elevation of the containers on frame bracket 463. Cylinder 462 operates a spring loaded piston rod 464 which moves longitudinally relative to the container assembly at the end of the film transfer conveyor belt. Attached to the end of rod 464 is an air cylinder actuated container engaging mechanism comprising a generally L-shaped bracket 465 mounted to rod 464; a second spring loaded air cylinder 466 pivotally mounted to the upright portion of the bracket; and a lever mechanism, including an elongated transversely disposed container assembly engaging plate 467 which is fixedly attached to a pivot link 468. Link 468 is pivotally attached at one end of the horizontal portion of the L-shaped bracket by pin 469, and at the other end of piston rod 470 of cylinder 466 by pin 471. Link 471 is set at an angle to plate 467 so that the plate may be pivoted by the movement of rod 470.

Figure 12:
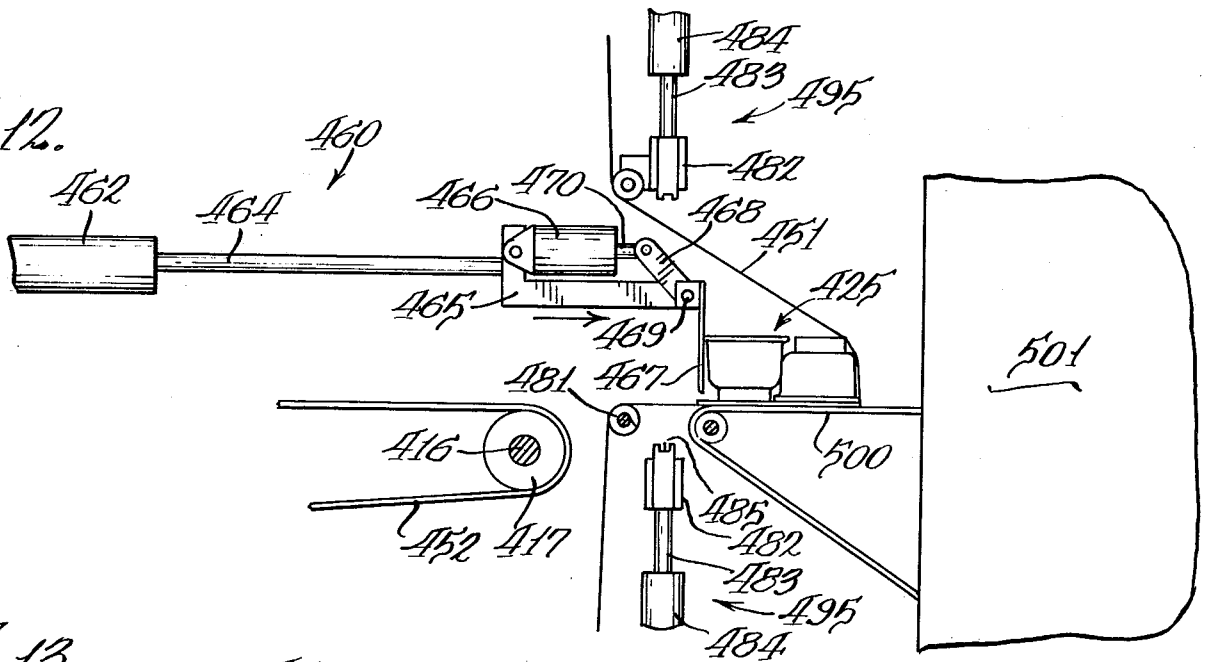
FIG. 12 is schematic side elevation view illustrating an intermediate position in the film wrapping operation.

Transfer mechanism 460 is designed to be in a retracted position, i.e. with the transfer plate 467 in a retracted position against the bottom portion of the horizontal portion of bracket 465, as illustrated in FIGS. 10 and 12, when rod 464 is retracted and rod 470 is in the extended position to allow container assemblies to pass thereunder. When the container assemblies have been moved to the end of the film wrap conveyor means, air is supplied to cylinder 462 to cause piston rod 464 to move bracket 465 longitudinally with respect to the film wrap conveyor and air is bled from air cylinder 466 to cause rod 470 to be retracted and thereby pivot plate 467 into a vertically disposed position. As rod 464 continues to move longitudinally, plate 467, FIG. 12, engages the container assembly and causes the assembly to bear against vertically disposed film 451 and be passed across the gap onto a shrink conveyor 500. As the assembly passes across the gap, the film encompass the leading edge and top and bottom of the assembly.

Figure 13:
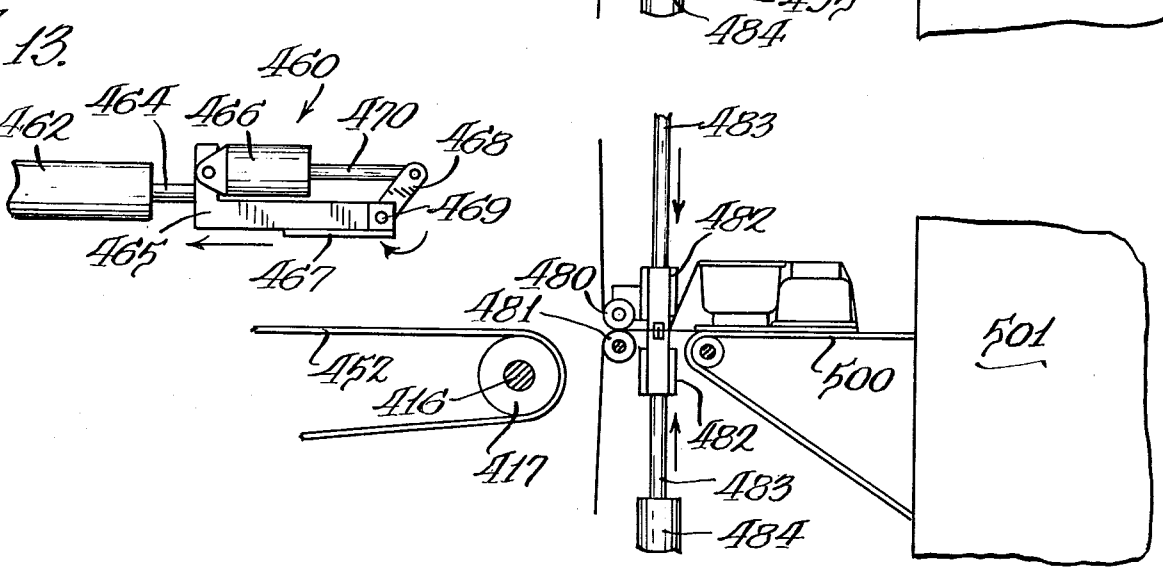
FIG. 13 is a view similar to FIG. 12 and illustrating the sealing and cutting operation of the film wrap apparatus.

With reference to FIG. 12, vertically disposed spaced apart rollers 480 and 481 provide vertical guidance for the thermoplastic film 451 as the container assemblies are fed by plate 467. The lower film guide roller 481 is mounted to frame 461 at the elevation of the bottom of the cardboard support by means of brackets 481*a*. The upper film roller 480 is mounted on a vertically movable film fusing and cutter mechanism 482 and is moved downwardly to cause the film to completely encompass the container assembly. As the container assemblies pass over the gap between film wrap conveyor 452 and shrink tunnel conveyor 500, two vertically disposed, opposing, spring-loaded air operated fusing mechanisms 495 are moved together to cause the film to be wrapped about the assembly when the pusher assembly 460 is retracted, as shown in FIG. 13. Each film fusing mechanism consists of a transversely disposed elongated fusing die 482 which is mounted on the end of a piston rod 483 of air cylinders 484. Air cylinders 484 are attached to the vertical machine frame member 461 and receive air from a supply in timed relationship with the rearward movement of piston rod 464 to cause the film fusing dies to be brought into engagement with the film web. Each die is formed with a generally U-shaped working edge which are heated by means (not shown). The corresponding opposing working edges of each die fuses the film at two spaced apart transverse locations to produce seam lines in the film and thus provide a closure of the container assembly and join the film supplied from rolls 453 into a continuous sheet of film. The lower film fusing die is provided with a hot-wire cutter 485 which severs the film between the transverse seams to separate the enveloped container assembly from the continuous supply of thermoplastic film.

After the film fusing dies have joined the film, the enveloped container assembly is transferred by heat-shrink conveyor 500 into a heating oven 501, as known in the art, wherein the thermoplastic film is caused to shrink to the contour of the cup assembly and thereby provide the completed cup package shown in FIG. 2.

The film 451 is of sufficient width to extend beyond the ends of the container assembly 425 to at least partially enclose the ends thereof. It will be appreciated that a second set of fusing dies disposed transversely to the ends of the assembly may be used to fuse the end portions of the film together to form complete enclosure of the assembly, if desired.

Alternate Embodiment of Transfer Mechanism

According to another embodiment of the present invention, a transver mechanism 600, illustrated in FIGS. 14–17, is used in place of the indexing conveyor 100 described above. As will be understood from the description that follows, the transfer mechanism 600 is adapted to remove filled and lidded containers 34′ from the filling machine and transfer them to the inverting mechanism 200. Unlike the indexing conveyor 100, however, the transfer mechanism 600 is designed to remove the containers 34′ directly from the filling machine conveyor means 32′ for transfer in generally horizontal end to end relationship into the inverting mechanism.

It will be understood by those skilled in the art that slight modifications to the filling machine of FIG. 1 would be made to adapt the machine for use with the transfer mechanism. For convenience of reference the same numerals are used in the description of transfer mechanism 600 to designate those elements which correspond to like elements in the previously described machine. Of course, other continuous or intermittent filling and sealing machines for nestable containers having apertured conveyor means for the containers may also be used with transfer mechanism 600.

Turning now to FIG. 14, the transfer mechanism 600 includes a drive assembly 601 located inside the continuous conveyor means 32′, at one end thereof, midway between spaced apart sprockets 74. Filled, sealed containers 34′ are moved counterclockwise from right to left, as viewed in FIG. 14, by the conveyor means 32′ around an arcuate path defined by the sprockets 74.

The drive assembly 601 is powered by a constantly rotating shaft 602 extending transversely of the machine. The shaft 602 is journaled in the frame F of the machine and is rotated in any suitable manner by the main drive mechanism (not shown) of the filling machine. An eccentric 603 is fixedly attached to shaft 602 and has a linkage arm 604 pivotally attached at one end thereto by a pin 605. The other end of linkage arm 604 is pivotally attached to one end of an elongated drive rod 610 by a pin 611. The drive rod 610 is slidably mounted in a fixed bushing 614 supported from the machine frame. Rotation of eccentric 603 by shaft 602 causes linkage arm 604 to move drive rod 610 in a back and forth motion. A collar 615 having an upwardly extending elbow-like projection 617 is fixedly attached to the other end of the drive rod 610, so that the projection 617 extends substantially upright. The projection 617 includes a hub 617*a* that is provided with an aperture 618, and a pair of spaced apart parallel primary linkage bars 620 and 621 are pivotally attached to hub 617*a* by a pin 623 extending through aperture 618. The lower ends of the linkage bars 620 and 621, as viewed in FIG. 14, are pivotally attached by a pin 629 to a hub 630*a* extending therebetween (see FIG. 15), and hub 630*a* is fixed to the end of a longitudinally extending shaft 630. The shaft 630 is slidably supported by an eyelet 631 extending downwardly from the surface of fixed bushing 614. A pair of spaced collars 635 and 636 are fixedly positioned on shaft 630 for limiting the axial travel of shaft 630 through the eyelet 631.

Figure 15:
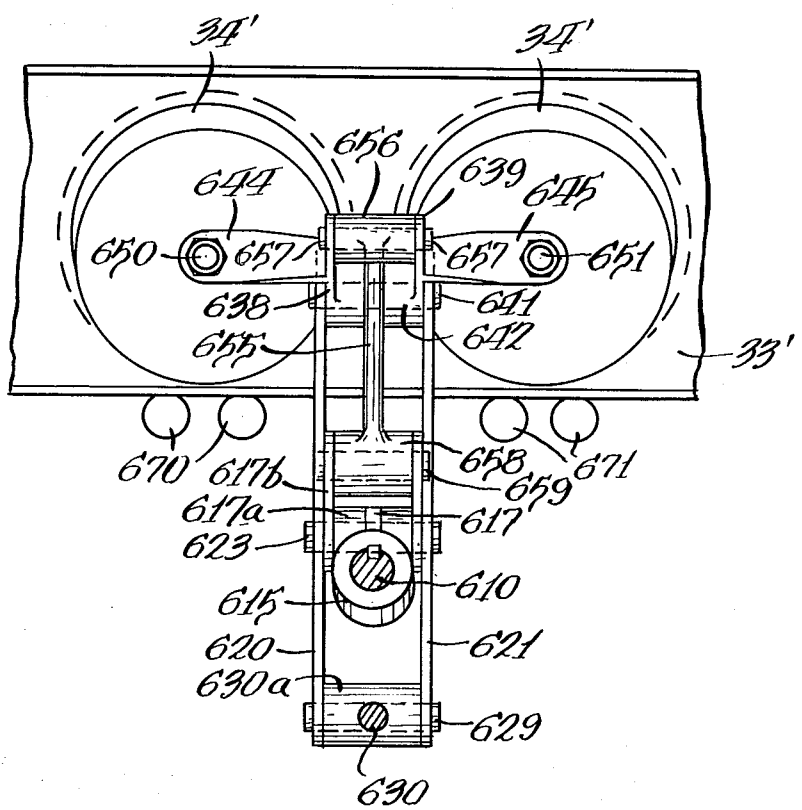
FIG. 15 is a sectional view taken along line 15—15 of FIG. 14.

The upper ends of linkage bars 620 and 621 are pivotally connected to parallel members 638 and 639 by a pin 641 extending through a hub 642 forming members 638 and 639. Flanges 644 and 645 extend outwardly from members 638 and 639 and have a pair of elongated plungers 650 and 651 fixedly attached thereto. The flanges 644 and 645 are twisted, as best seen in FIG. 15, in order to horizontally orient the plungers 650 and 651. The plungers 650 and 651, which are provided with blunted head members 653, are maintained in a generally horizontal position by a secondary linkage bar 655. A hub 656 at the upper end of secondary linkage bar 655 is pivotally attached between the parallel members 638 and 639 by a pin 657, and a hub 658 at the lower end of bar 655 is pivotally attached between rearward and upwardly extending arms 617*b* fixed to projection 617 by a pin 659 extending through aperture 619 in arms 617b.

Filled and lidded containers 34' are carried in rows on the conveyor means 32', two at a time, in side by side relationship, by a plurality of plates 33' positioned side by side along the length of the conveyor. Apertures are provided in the plates 33' for receiving said containers 34, which rest in the apertures on rims 34*c*.

Positioned outside the filling machine in end to end relationship with conveyor means 32' are pairs of horizontally disposed longitudinal, parallel transfer rails 670 and 671. Rails 670 are positioned in alignment with one row of apertures in the conveyor means 32', and rails 671 are positioned in longitudinal alignment with the other row of apertures in the conveyor means 32. The horizontal rails 670 and 671 are positioned at a height approximate to the centers of sprockets 74.

Figures 16, 17:
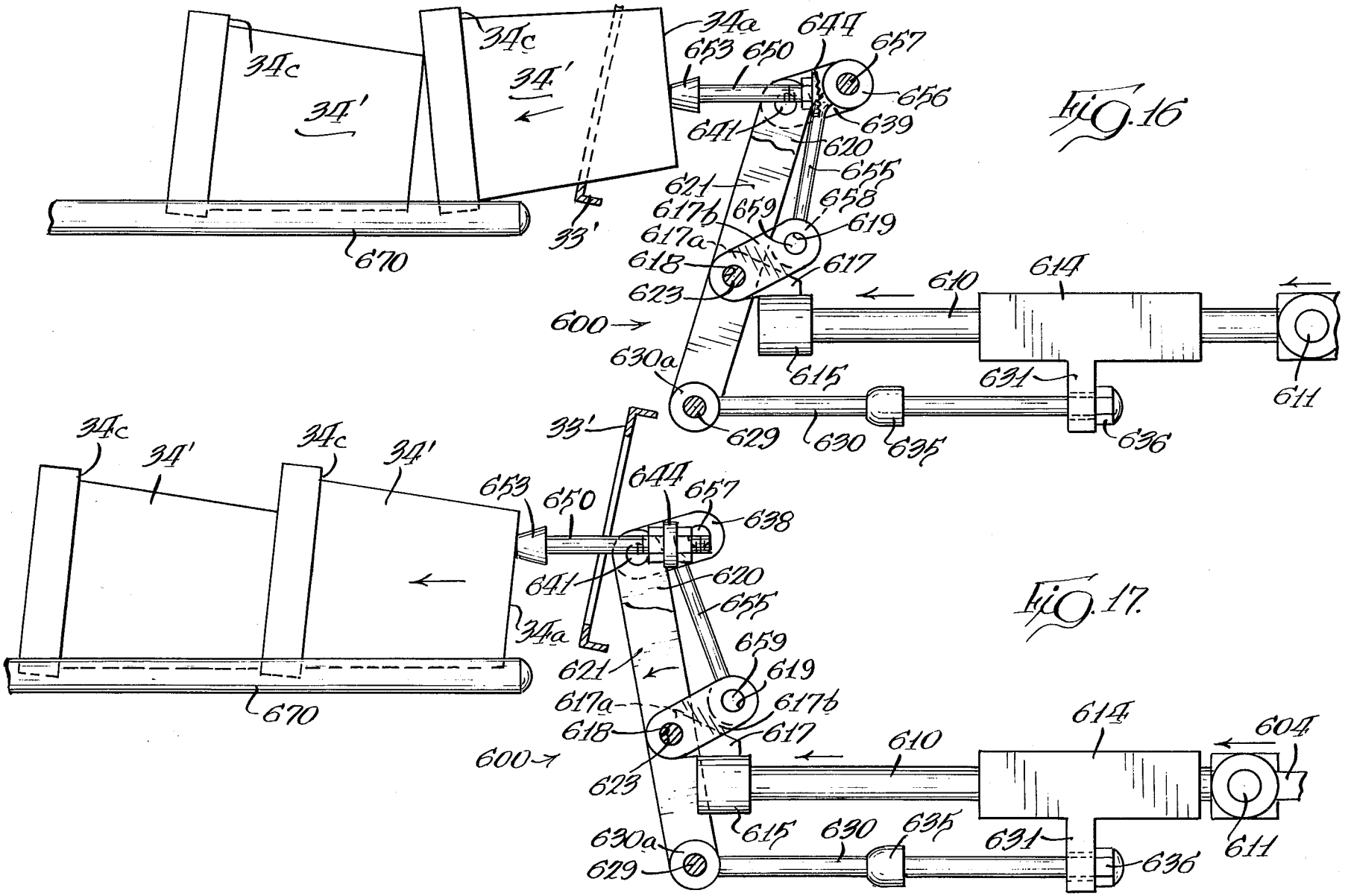
FIG. 16 is a view like that of FIG. 14 but illustrating the transfer mechanism partially advanced.
FIG. 17 is a view like that of FIGS. 14 and 16, but illustrating the transfer mechanism fully advanced.

In operation, the drive asembly 601 is timed with the conveyor means 32' such that it is activated as containers travel around sprockets 74 and into alignment with the longitudinal extent of plungers 650 and 651. From FIG. 15 it is evident that plungers 650 and 651 are spaced apart a distance corrsponding to the spacing between containers 34' as defined by the apertures in plates 33'. Eccentric 603 initially moves linkage arm 604 from right to left, i.e., from the position of FIG. 14 toward the position of FIG. 16, causing drive rod 610 to slidably advance in fixed bushing 614. At the same time, shaft 630 axially slides through eyelet 631 until the collar 636 abuts against the eyelet (see FIG. 16). As drive rod 610 advances, plungers 650 and 651 also advance into engagement with the bottoms 34a of containers 34', which are oriented in a substantially horizontal position. The linkage arm 604, not yet fully extended by eccentric 603, continues to advance drive rod 610 after collar 636 stops movement of shaft 630, causing the linkage bars 620 and 621 to pivot about pin 629 in a cunterclockwise direction, as best seen in FIG. 17. This advances the plungers 650 and 651 from the position of FIG. 16 to the position of FIG. 17 and pushes the containers 34' out of the apertures in plate 33' and directly onto the rails 620 and 621 where they rest on their sides. As linkage bars 620 and 621 pivot about pin 629, secondary linkage bar 655 maintains the plungers 650 and 651 generally horizontal during their advancement.

Continued rotation of eccentric 603 beyond 180° causes linkage arm 604 to move away from a horizontal position pulling drive rod 610 with it from left to right as viewed in FIG. 14 toward the retracted position. As the drive rod 610 slides within fixed bushing 614, shaft 630 slides through eyelet 631 until collar 635 abuts against the eyelet, stopping the shaft 630. Continued movement of drive rod 610 by linkage arm 604, with shaft 630 stopped, causes the linkage bars 620 and 621 to pivot about pin 629 and rotate back to its original position shown in FIG. 14. This sequence is repeated each time a plate 33' is brought into alignment with plungers 650 and 651 to intermittently place pairs of containers on rails 670 and 671.

Transfer rails 670 and 671 in transfer mechanism 600 are adapted to take the place of the conveyor belts 101 and indexing augers 102 of the indexing conveyor 100 in the previously described embodiment. The drive assembly 601 pushes successive containers 32 along the rails 670 and 671 in end to end fashion and adjacent containers on each set of rails in side by side relationship. The containers butt against one another and are moved intermittently along rails 670 and 671 by drive assembly 601. It is noted that containers 34' are horizontally oriented on rails 670 and 671 for transport to inverting mechanism 200, as opposed to being vertically oriented as on the conveyor belts 101 of indexing conveyor 100. The inverting mechanism 200, however, is capable of receiving the containers 32' in a horizontal or vertical orientation and operates in substantially the same manner as described above.

With reference to FIG. 14, containers 34' approach inverting mechanism 200 on transfer rails 670 and 671 similar to the containers 34 on conveyor belts 101, but in a horizontal orientation. Fingers 230 pivotally engage a horizontally oriented container 34' at the rim 34*c*. Once lifted, the weight distribution of the container 34' causes the containers to rotate in an upright orientation. Instead of tipping off conveyor belt 101 onto plates 220 as shown for upright oriented containers, horizontally oriented containers 34', according to the instant embodiment, would be pushed off the ends of rails 670 and 671 and slide directly onto the inclined plates 220. Such containers would be transported along an arcuate path and deposited on belt 251 in an inverted condition.

It will be readily observed from the foregoing detailed description of the present invention and in the illustrated embodiments thereof, that numerous variations and modifications may be made without departing from the true spirit and scope of the invention.

For example, the present invention contemplates the production of a package like that shown in FIG. 2, but wherein the support member 51 is eliminated. In such a package, the adjacent nested containers derive sufficient support from themselves and from the heat-shrunk sheet of film 52 to retain the containers together as an integral package.

What is claimed is:

1. A method of packaging nestable containers having different dimensions at opposite ends comprising the steps of: continuously feeding said containers in side by side relationship along transversely spaced adjacent process paths; engaging each container in each path and inverting alternate containers in each of said process paths while alternating said container inversion between said process paths such that inverted containers are in side by side relationship with noninverted containers; collating said containers into multiple row groups of predetermined number; moving a support member beneath each of said collated groups; transferring said groups in timed relationship with the moving of said support members to a second process path such that each group is positioned on a support member to form an assembly; enveloping each assembly in a film of thermoplastic heat-shrinkable material; and transferring said enveloped assemblies to a heating means whereby said film will be shrunk to the contour of said assembly to provide a finished package.

2. The method according to claim 1, further including feeding said containers in an upright orientation along said process paths.

3. The method according to claim 1, further including feeding said containers in a horizontal orientation end to end along said process paths.

4. The method according to claim 3, wherein said alternate inverting step includes: feeding alternate containers in each process path onto inclined inverting plates; moving said alternate containers through an arcuate path such that the containers will be inverted; and releasing said alternate containers for further processing.

5. The method according to claim 4, wherein said alternate inverting step further includes: feeding the remaining containers in each process path onto transfer fingers; moving said remaining containers through an arcuate path such that the containers are rotated into an upright vertical orientation, and releasing said alternate containers for further processing.

6. The method according to claim 1, wherein said feeding step includes: rotating said conainers from an upright vertical orientation to a horizontal orientation, and feeding said horizontally oriented containers end to end onto pairs of horizontally disposed parallel guide rails.

7. A method of packaging nestable containers having different dimensions at opposite ends comprising the steps of: continuously feeding multiple rows of containers along transversely spaced process paths such that corresponding containers in different rows are in side by side relationship; engaging each container in each path and inverting alternate containers in each row while alternating said inverting step between said adjacent rows so that the noninverted containers are in side by side relationship with inverted containers; collating said rows of alternately inverted side by side containers into nested groups; and transferring said groups for subsequent packaging.

8. The method according to claim 7, further including feeding said containers in an upright orientation along said process paths.

9. The method of claim 8, wherein said alternate inverting step includes: tipping alternate containers in each process path, gripping said tipped containers and moving said tipped containers through an arcuate path such that the containers will be inverted; and releasing the containers for further processing.

10. The method according to claim 7, wherein said feeding step includes: rotating said containers from an upright vertical orientation to a horizontal orientation, and feeding said horizontally oriented containers end to end onto pairs of horizontally disposed parallel guide rails.

11. The method according to claim 7, further including feeding said containers in a horizontal orientation end to end along said process paths.

12. The method according to claim 11, wherein said alternate inverting step includes: feeding alternate containers in each process path onto inclined inverting plates; moving said alternate containers through an arcuate path such that the containers will be inverted; and releasing said alternate containers for further processing.

13. The method according to claim 12, wherein said alternate inverting step further includes: feeding the remaining containers in each process path onto transfer fingers; moving said remaining containers through an arcuate path such that the containers are rotated into an upright vertical orientation; and releasing said alternate containers for further processing.

14. A method of packaging nestable containers having different dimensions at opposite ends comprising the steps of: continuously feeding said containers in an upright orientation in side by side relationship along adjacent process paths; tipping alternate containers in each process path, gripping said tipped containers and moving said tipped containers through an arcuate path such that the containers will be inverted; releasing said inverted containers; alternating said inverting step between adjacent rows so that noninverted containers are in side by side relationship with inverted containers; collating said containers into multiple row groups of predetermined number; moving a support member beneath each of said collated groups; transferring said groups in timed relationship with the moving of said support members to a second process path such that each group is positioned on a support member to form an assembly; enveloping each assembly in a film of thermoplastic heat-shrinkable material; and transferring said enveloped assemblies to a heating means whereby said film will be shrunk to the contour of said assembly to provide a finished package.

15. Apparatus for packaging nestable containers having different dimensions at opposite ends in nested groups, comprising: transfer means for moving said containers in side by side relationship along transversely spaced process paths; inverting means located adjacent the end of each said path for receiving and engaging each container from said transfer means, said inverting means having means for inverting every other container in adjacent paths and for orienting the noninverted containers vertically upright; means for receiving said containers from said inverting means; means for collating said containers into multiple row groups of predetermined number; means for moving a support member beneath each of said collated groups; means for transferring said groups in timed relationship with the moving of said support members to a second process path such that each group is positioned on a support member to form an assembly; means for enveloping each assembly in a film of thermoplastic heat-shrinkable material; and means for transferring said enveloped assemblies to a heating means whereby said film will be shrunk to the contour of said assembly to provide a finished package.

* * * * *